US011247890B2

(12) United States Patent
Urban et al.

(10) Patent No.: US 11,247,890 B2
(45) Date of Patent: Feb. 15, 2022

(54) CONTAINED HOLDER FOR AN OPEN JET FILLER

(71) Applicant: KRONES AG, Neutraubling (DE)

(72) Inventors: Ralf Urban, Neutraubling (DE); Heinz Hennek, Neutraubling (DE)

(73) Assignee: KRONES AG, Neutraubling (DE)

( * ) Notice: Subject to any disclaimer, the term of this patent is extended or adjusted under 35 U.S.C. 154(b) by 28 days.

(21) Appl. No.: 16/719,556

(22) Filed: Dec. 18, 2019

(65) Prior Publication Data

US 2020/0189897 A1 Jun. 18, 2020

(30) Foreign Application Priority Data

Dec. 18, 2018 (DE) ..... 10 2018 132 635.1

(51) Int. Cl.

| | |
|---|---|
| ***B67C 3/24*** | (2006.01) |
| ***B67C 3/22*** | (2006.01) |
| ***B65B 3/04*** | (2006.01) |
| ***B65B 43/54*** | (2006.01) |
| ***B65B 43/46*** | (2006.01) |

(52) U.S. Cl.

CPC ..... *B67C 3/242* (2013.01); *B65B 3/04* (2013.01); *B65B 43/46* (2013.01); *B65B 43/54* (2013.01); *B67C 3/225* (2013.01)

(58) Field of Classification Search

CPC ..... B65B 3/04; B65B 43/54; B65B 43/46; B65B 43/42; B67C 3/242; B67C 3/225; B67C 3/24; B67C 3/26; B67C 3/02

See application file for complete search history.

(56) References Cited

U.S. PATENT DOCUMENTS

| | | | | | |
|---|---|---|---|---|---|
| 3,105,526 | A | * | 10/1963 | Hurtig | B65B 43/60 141/171 |
| 4,126,043 | A | * | 11/1978 | Schurmann | G01N 1/18 141/34 |
| 4,363,338 | A | * | 12/1982 | Brown | B65B 3/045 141/114 |
| 4,588,001 | A | * | 5/1986 | Leonard | B67C 3/004 141/145 |
| 5,791,385 | A | * | 8/1998 | Stahlecker | B65B 3/22 141/171 |

(Continued)

FOREIGN PATENT DOCUMENTS

| | | | |
|---|---|---|---|
| CN | 102020111 | A | 4/2011 |
| CN | 106183406 | A | 12/2016 |

(Continued)

OTHER PUBLICATIONS

European Search Report and Written Opinion as issued in connection with European Application No. EP 19 21 7403 dated May 18, 2020.

*Primary Examiner* — Nicolas A Arnett
(74) *Attorney, Agent, or Firm* — Maschoff Brennan

(57) ABSTRACT

Container holder and filling device for filling containers with a filling product, for the open jet filling of containers with a beverage in a beverage filling plant. The container holder comprises: a holding portion which is set up for the receiving and holding of a container; a main carrier which is attachable to the filling device; and a compensation carrier which is adjustable in a compensation direction relative to the main carrier and to which the holding portion is attached.

17 Claims, 3 Drawing Sheets

(56) References Cited

U.S. PATENT DOCUMENTS

| | | | | |
|---|---|---|---|---|
| 7,243,483 | B2 * | 7/2007 | Clusserath | B67C 3/045 141/290 |
| 7,278,451 | B2 * | 10/2007 | Cavallari | B67C 3/202 141/152 |
| 7,845,144 | B2 * | 12/2010 | Yuyama | G07F 17/0092 53/249 |
| 8,505,594 | B2 * | 8/2013 | Krulitsch | B67C 3/2608 141/104 |
| 8,556,062 | B2 * | 10/2013 | Stoiber | B65G 47/847 198/470.1 |
| 9,365,403 | B2 * | 6/2016 | Vorwerk | B67C 3/04 |
| 9,463,591 | B2 * | 10/2016 | Winzinger | B65G 29/00 |
| 10,500,782 | B2 * | 12/2019 | Desoutter | B29C 49/421 |
| 2009/0159152 | A1 * | 6/2009 | Till | B08B 9/42 141/145 |
| 2009/0314385 | A1 * | 12/2009 | Goldbrunner | B67C 3/285 141/83 |
| 2011/0023996 | A1 * | 2/2011 | Laumer | B67C 7/0073 141/1 |
| 2014/0360621 | A1 * | 12/2014 | Clusserath | B65B 3/28 141/9 |
| 2017/0129759 | A1 * | 5/2017 | Cocchi | B67C 3/007 |
| 2018/0354764 | A1 * | 12/2018 | Comin | B67C 3/02 |
| 2019/0185308 | A1 * | 6/2019 | Dreger | B65G 47/847 |

FOREIGN PATENT DOCUMENTS

| | | | |
|---|---|---|---|
| CN | 207375729 | U | 5/2018 |
| DE | 102004042516 | B4 | 3/2006 |
| DE | 102011010955 | B4 | 8/2012 |
| DE | 102011016760 | A1 | 10/2012 |
| DE | 102015110765 | A1 | 1/2017 |
| EP | 2295352 | A2 | 3/2011 |
| EP | 2511205 | A2 | 10/2012 |
| JP | 2009269660 | A | 11/2009 |
| KR | 20150019420 | B1 | 2/2015 |

* cited by examiner

CONTAINED HOLDER FOR AN OPEN JET FILLER

CROSS-REFERENCE TO RELATED APPLICATION

This application claims priority to German Patent Application No. 10 2018 132 635.1, filed on Dec. 18, 2018.

FIELD

The invention relates to a container holder for a filling device for filling containers with a filling product, for example for the open jet filling of containers with a beverage in a beverage filling plant. The invention additionally relates to a filling device which is provided with such container holders.

BACKGROUND

In open jet filling the container to be filled is positioned below a filling member which then introduces the liquid filling product substantially vertically downward into the container mouth. In this case, the container mouth does not abut sealingly against the filling member but is spaced from it by a certain vertical distance so that the air displaced by the filling product is able to escape into the surrounding area.

If open jet filling is carried out in a rotary machine where the container and the associated filling member move along a circular trajectory during the filling process, the filling jet is deflected to a greater or lesser extent in dependence on the centrifugal force acting thereon. The transport speed of the containers cannot be arbitrarily increased for this reason, for, from a certain speed, the deflection of the filling jet is so great that said filling jet no longer contacts the container mouth reliably. In other words, the output performance of a rotary machine is not just restricted by the rate of flow of the filling members but also, or even predominantly, by the centrifugal forces acting on the filling jet.

A possible solution to the problem consists in increasing the output performance of the rotary machine as a result of designing the same overall in a larger manner, i.e. provided with a larger pitch circle and additional filling members. However, this results in higher costs both in the procurement and during the operation of the facility. Maintenance expenditure is increased as is the required adjustment or installation space.

DE 10 2011 016 760 A1 proposes moving the filling member and the container to be filled relatively to one another for compensation of the deflection of the filling jet such that the filling jet enters the container through the container opening in a substantially central manner.

A disadvantage of compensating for the deflection of the filling jet as a result of a relative adjustment of the container carrier and of the filling member consists in that either the container carriers or the filling members of the facility have to be redesigned in a not inconsiderable manner in order to be displaceable or tiltable relative to one another without impairing their functionality. If the compensation is performed as a result of adjusting the filling members, it must be ensured that the filling behaviour is not modified as a result. If, on the other hand, the compensation is performed by repositioning the container carriers, it must be ensured that the containers can continue to be securely gripped, held and transferred to subsequent stations. Retrofitting existing rotary machines is consequently not easily possible.

SUMMARY

A container holder for a device for filling containers with a product. The container holder comprising a holding portion configured to receive and hold a container and a main carrier attachable to a filling device for filling the container with a filling product. The container holder further comprises a compensation carrier attached to the holding portion, the compensation carrier adjustable in a compensation direction (K) relative to the main carrier.

Further advantages and features of the present invention can be seen from the following description of embodiments. The features described there can be implemented on their own or in combination with one or multiple of the above-described features, insofar as the features do not contradict one another. The following description of embodiments is effected, in this case, with reference to the accompanying drawings.

BRIEF DESCRIPTION OF THE FIGURES

Embodiments of the invention are explained in more detail by the following description of the Figures, in which.

DETAILED DESCRIPTION

Figure 1A:
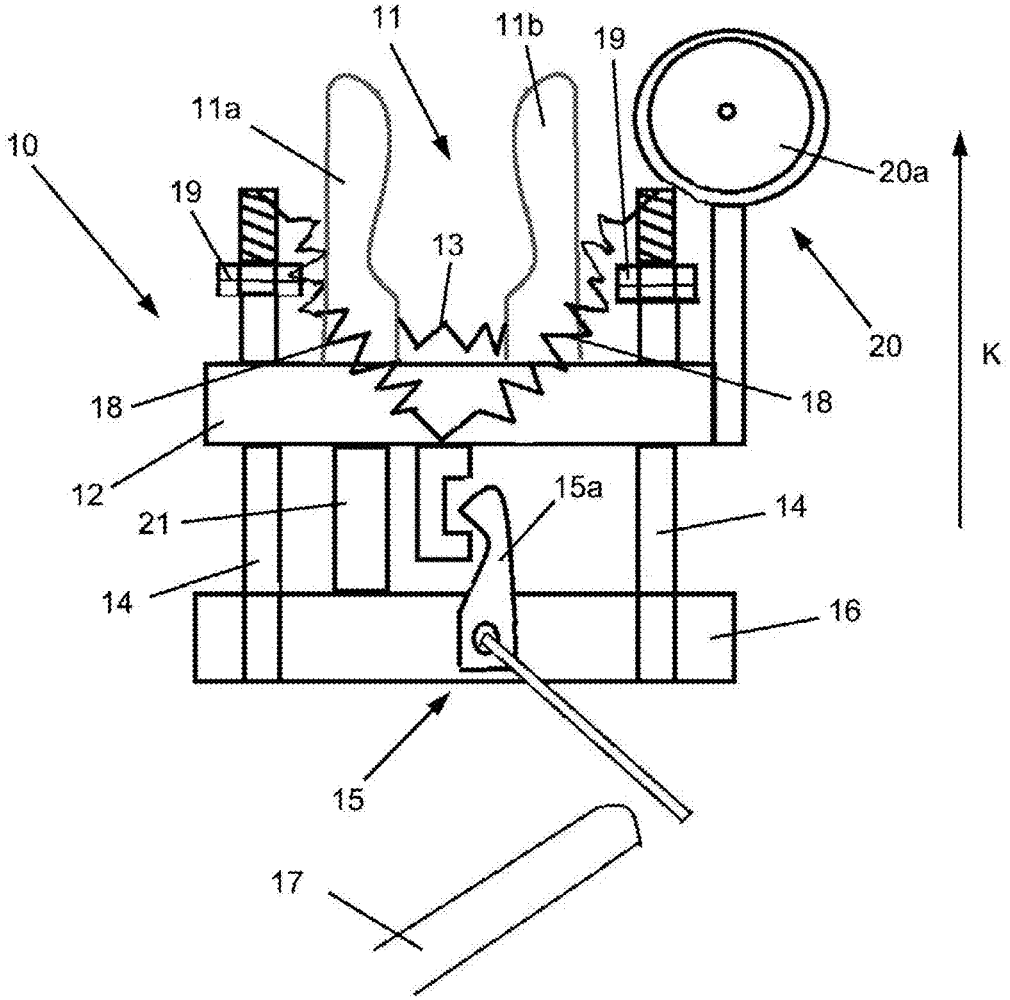
FIG. 1*a* shows a schematic top view of a container holder, locked in the normal state, that is in the central position without compensation of the deflection of the filler jet.

The disclosure provides a container holder for a filling device for filling containers with a filling product as well as a filling device, in particular in simplifying the retrofitting of an existing filling device with container holders which are set up for compensation of a possible deflection of the filling jet.

Simplifying the retrofitting of an existing filling device among other things is achieved by a container holder with the features of claim 1 as well as a filling device with the features of claim 11. Advantageous further developments can be found in the subclaims, the following representation of the invention and the description of embodiments.

The container holder according to the invention is provided for a filling device for filling containers with a filling product. The container holder is used in a manner in open jet fillers for the filling of beverages. The container holder comprises a holding portion which is set up for receiving and holding a container as well as a main carrier which is attachable to the filling device or is attached thereto. The container holder additionally comprises a compensation carrier which is adjustable relative to the main carrier in a compensation direction and to which the holding portion is attached.

The designation "adjustable" means that the position and/or orientation of the compensation carrier relative to the main carrier is modifiable, for example is pivotable and/or displaceable. According to an embodiment, the compensation carrier is set up to be linearly displaceable relative to the main carrier. It must be pointed out that the compensation carrier and the holding portion can be realized as separate components, integrally or in one piece.

Container holders in said design can contribute to an increase in the output performance of a filling device which is provided with said container holders as it is possible to compensate for a deflection of the filling jet by the adjustability of the main carrier, consequently of the holding portion. If a significant deflection of the filling jet occurs, for instance in the case of an increase in the output performance of the filling machine as a result of an increase in speed of a possible filler carousel, the container holder is able to be transferred into a compensation state. This applies, in particular, to the filling of comparatively small-volume containers where an increase in performance output is defined less by the maximum flow rate of the filling members but more by the speed of rotation of the filler carousel. Existing filling devices can be retrofitted with the improved container holders in a simple manner as it is possible to connect to the existing fastening portions for conventional container holders by the main carrier. Designs relating to the inlet and outlet, the container transfer, the filling members etc. do not have to be fundamentally modified but at most adapted.

The holding portion may include two clamping arms which are mounted so as to be pivotable on the compensation carrier and/or are produced from a flexible material. In this connection, the clamping arms are prestressed into a compressed position. In this way, a container can be clamped into the holding portion simply as a result of light pressure, by the clamping arms being pressed a little apart from one another and exerting a sufficient pressure on the container in the holding state in order to hold said container. A holding spring, which is arranged between the clamping arms and is fastened thereto such that said clamping arms are pressed or pulled into a particular position, can be provided to generate the prestressing.

The container holder comprises one or multiple guide elements, wherein the compensation carrier is displaceable along the compensation direction guided by the guide elements. The function for compensating a deflection of the filling jet can be realized in a technically simple and reliable manner in this way. The guide elements are fastened to the main carrier. In the case of a rotary machine, the compensation direction corresponds to the radial direction of the filler carousel or comprises at least one non-vanishing vector component in this direction.

The compensation carrier is adjustable from a normal state, in which the mouth of a container held therein is situated substantially centrally under the outlet of an associated filling member of the filling device, into at least one compensation state, in which the mouth of the container is displaced relative to the outlet of the filling member, and vice versa. The compensation state consequently designates decentral holding of the container relative to the outlet of the filling member. Deflection of the filler jet as a result of centrifugal forces is compensated for in this manner. It must be pointed out that it is obviously possible to provide multiple compensation states in order to be able to compensate for different degrees of deflection of the filler jet. In particular, a continuous transfer from the normal state into a maximum compensation state and vice versa can be realized.

By the container holder being additionally transferable into the above-defined normal state, said container holder is also usable in a conventional filling device without compensation or where there is a sufficiently small output performance where no deflection of the filling jet or only insignificant deflection of the filling jet occurs. This can be the case, for example, when filling comparatively large containers, such as, for instance, 21 bottles, when the output performance of the filling plant is restricted first and foremost by the volume throughput of the filling member.

The compensation carrier is prestressed into one of the states, for instance the compensation state, as a result of which possible means for the active adjustment of the compensation carrier only have to serve one direction whereas the compensation carrier returns automatically into the starting state. A realization of such prestressing, which is simple and reliable from a mechanical engineering point of view, can be accomplished by one or multiple compensation springs. One end of such a compensation spring can be fastened, for example, to the compensation carrier, whilst the other end is fastened to the guide element or main carrier.

The container holder includes a locking device which is set up to fix the compensation carrier in the normal state and/or compensation state. In this connection, a fixing or locking relative to the main carrier is meant first and foremost. The relevant state is securely maintained in this way. If the container holder is fixable in the normal state, said container holder can be switched in a simple and reliable manner between a normal operation without compensation and a compensating operation. The locking device is switchable in a program-controlled manner in order to avoid manual operator interventions.

A realization of the locking device which is simple and reliable from a mechanical engineering point of view can be effected by at least one hook which is attached so as to be pivotable on the main carrier and/or compensation carrier and is movable into engagement with a counter piece on the other carrier and is releasable from said engagement.

The container holder comprises one or multiple stops, so as to be adjustable, for defining the normal state and/or a compensation state. In particular, the end position, i.e. the maximum compensation state, can be defined by a stop, as a result of which reliable and constant positioning of the compensation carrier is realized.

The container holder comprises an adjusting portion which is set up to adjust the position of the compensation carrier. The adjusting portion can carry out the positioning, i.e. changing the position or the state, of the compensation carrier in a mechanical, electrical, magnetic, hydraulic, pneumatic or other manner. According to an embodiment, the positioning is effected mechanically by the adjusting portion including a roller which is set up to interact with a cam segment of the filling device. In this way, the transfer from the normal state into the compensation state and vice versa is effected particularly reliably, in a structurally simple and easily retrofittable manner.

The above object is additionally achieved by a filling device having one or multiple container holders according to the described realization variants. The filling device is set up, in this connection, to move containers by the container holders during the filling with a filling product along a trajectory which is curved at least in portions. A deflection of the filling jet, which can be compensated for by the container holders according to the invention, can occur in the curved portions as a result of centrifugal forces.

The features, technical effects, advantages and example embodiments which have been described with reference to the container holder, apply analogously to the filling device.

According to a particularly embodiment, the filling device is a rotary machine with a filler carousel which comprises the container holders and transports said container holders along a circle segment during the filling of the containers, wherein the compensation direction corresponds, in this case, to the radial direction of the filler carousel or comprises at least one non-vanishing vector component in said direction.

The filling device comprises a cam segment, which, together with the adjusting portions of the container holders, is set up such that in the region of the container transfer to the holding portion and/or container output to a subsequent station, the compensation carrier is moved into the normal state by a cam of the cam segment which acts on the roller, whereas the compensation carrier is situated in a compensation state during the filling.

A filling device provided with compensatory container holders can comprise a control unit/logic unit which determines the correct compensation state, for example calculates it in dependence on the speed of rotation of the filler carousel and actuates it. Such a control unit can be set up, additionally, in order to indicate whether the increase in performance output as a result of eccentric filling impedes an enlargement of the filler pitch circle. Eccentric filling can thus result in an increase in performance output of the filling device.

Some embodiments are described below by way of the Figures. In this case, identical or similar elements or elements having the same effect are provided with identical reference symbols in the various Figures, and a repeated description of said elements is dispensed with in part in order to avoid redundancies.

FIG. 1*a* shows a schematic top view of a container holder 10. The container holder 10 is set up in order to receive a container 1 (cf. FIG. 1*b*), to hold it securely for filling and to transfer it to a subsequent station or transport device once it has been filled. In this connection, the container 1 is transported along a trajectory, which is curved at least in portions, at least during the filling by a filling member 2 (cf. FIG. 1*b*). The container 1 is held by the container holder 10 at its mouth or in the region of the mouth. The container 1, for instance a bottle to be filled with a beverage, is consequently held suspended by the container holder 10. However, there is no restriction with reference to the type of holding as long as the containers 1 can be received, held securely and delivered again. In a particular manner, the container holder 10 is a component part of a rotary machine with a filler carousel which comprises multiple container holders 10 at regular distances and transports said container holders along a circle segment, whilst one or multiple containers 1 are filled at the same time by associated filling members 2.

The container holder 10 comprises a holding portion 11 which, according to the present example embodiment, includes two clamping arms 11*a*, 11*b* which are attached to a carrier which is designated herein as compensation carrier 12. The clamping arms 11*a*, 11*b* are mounted so as to be pivotable on the compensation carrier 12, it being possible for them to be prestressed into a compressed position by a holding spring 13. In this way, a container 1 can be clamped into the holding portion 11 as a result of light pressure, by the clamping arms 11*a*, 11*b* being pressed a little apart from one another by the container 1 itself and sufficient pressure being exerted onto the container 1 by the holding spring 13 in order to hold it. As an alternative to this, the clamping arms 11*a*, 11*b* can be produced from a flexible material and consequently have inherent flexibility so that, where applicable, it is possible to dispense with a holding spring 13. In addition, it must be pointed out the holding portion 11 can be realized in a different manner. In the simplest case, the holding portion 11 just comprises a recess in which the containers 1 are suspended. The holding portion 11 and the compensation carrier 12 can be realized as separate components, integrally or also in one piece.

The compensation carrier 12 is set up so as to be adjustable so that the holding portion 11 is able to be displaced by a certain amount. In the present example embodiment, the compensation carrier 12 is displaceable along a component direction K guided by guide elements 14. In the case of a rotary machine, the compensation direction K corresponds to the radial direction of the filler carousel or comprises at least one non-vanishing vector component in said direction.

Figure 1B:
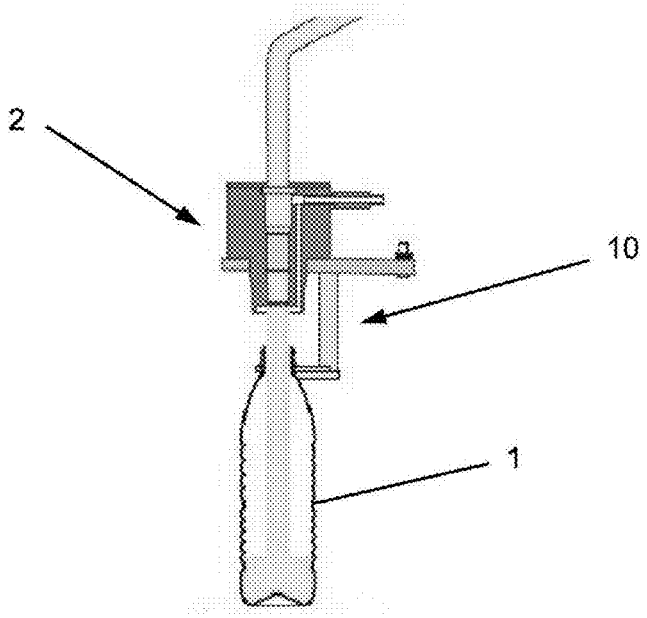
FIG. 1*b* shows a schematic side view of the container holder of FIG. 1*a* with a received container and a filling member arranged above it.

FIGS. 1*a* and 1*b* show the container holder 10 in a normal state in which the mouth of a container 1 held therein is situated substantially centrally under the outlet of an associated filling member 2 during the filling process. The normal state consequently designates a position in which compensation for a possible deflection of a filler jet does not take place.

The container holder 10 is consequently also usable in a conventional filling device without compensation or in the case of a sufficiently small performance output where no deflection of a filler jet or only insignificant deflection of a filler jet occurs. This can be the case, for example, when filling comparatively large containers 1, such as, for instance, 21 bottles, when the output performance of the filling plant is restricted first and foremost by the volume throughput of the filling member 2.

In order to maintain the normal state securely, a locking device 15 which fixes the compensation carrier 12 is provided. According to the present example embodiment, the locking device 15 includes a hook 15*a* which is attached to a carrier, which is designated herein as main carrier 16, so as to be pivotable. The hook 15*a* interacts with a counter piece, for example provided on or attached to the compensation carrier 12. The locking device 15 can be set up additionally or as an alternative to this for locking one or multiple compensation states. The locking device 15 is switchable in a program-controlled manner in order to avoid manual operator interventions. The actuation of the locking device 15 is indicated in FIG. 1 by a pneumatic cylinder 17. As an alternative to this, the actuation of the locking device 15 can be effected by a bar switch, in an electromotive, hydraulic or other manner.

The main carrier 16 is provided for attaching the container holder 10 to a filling device, for instance for fastening to corresponding receiving a filler carousel.

Figure 2:
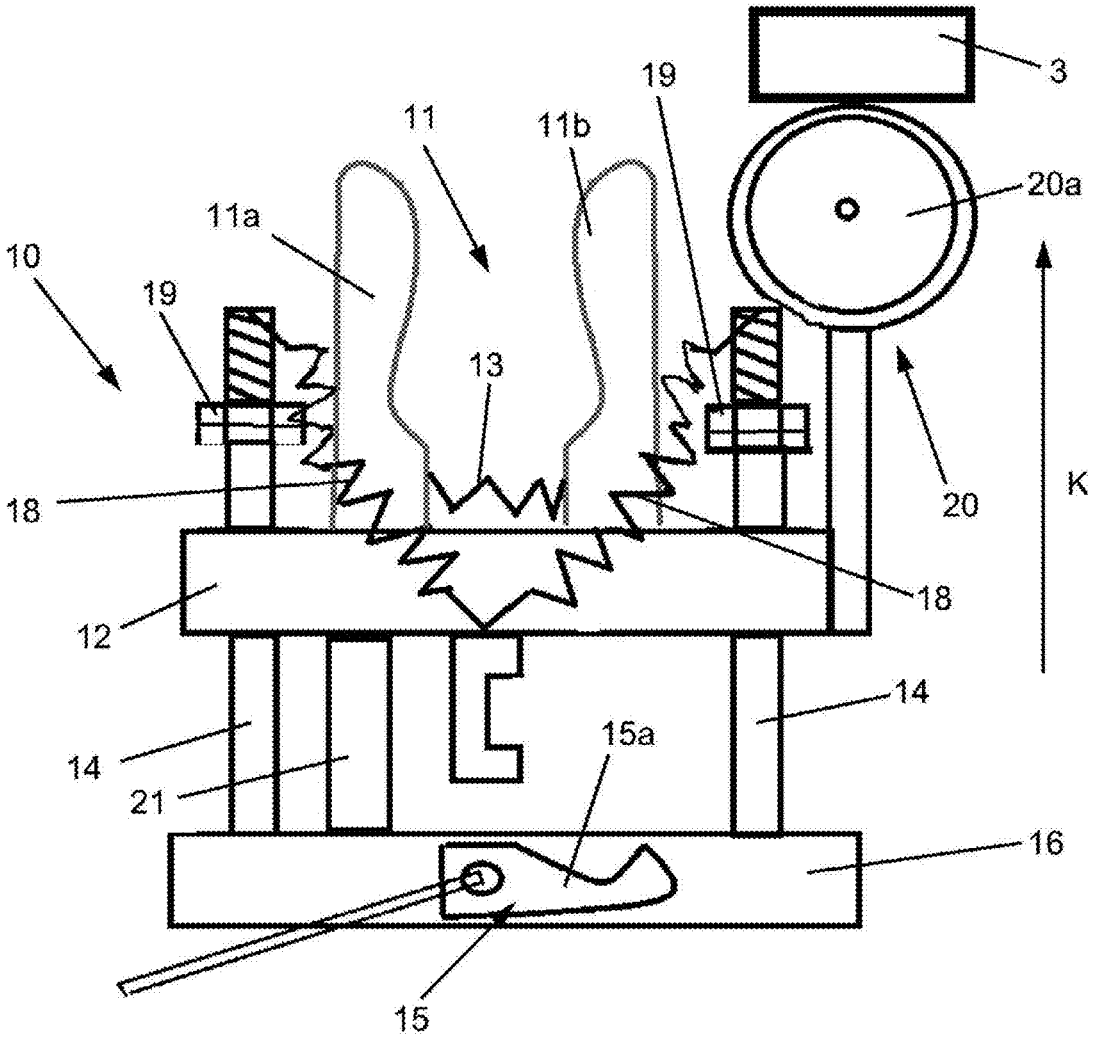
FIG. 2 shows a schematic top view of a container holder of FIG. 1*a*, unlocked in the normal state.

If a significant deflection of the filling jet occurs, for instance when the performance output of the filling machine increases as result of an increase in the speed of the filler carousel, the container holder 10 can be transferred into a compensation state by releasing the locking device 15, as shown in FIG. 2.

For this purpose, the compensation carrier 12 moves outward along the guide elements 14, i.e. in the direction in which the filling jet is deflected, as a result of which the container 1 held by the container holder 10 is moved to a decentral position. I.e. the container mouth is situated offset to the outlet of the filling member 2, as can be seen in FIG. 3*b*. The deflection of the filling jet caused as a result of centrifugal forces is compensated for in this way.

Figure 3A:
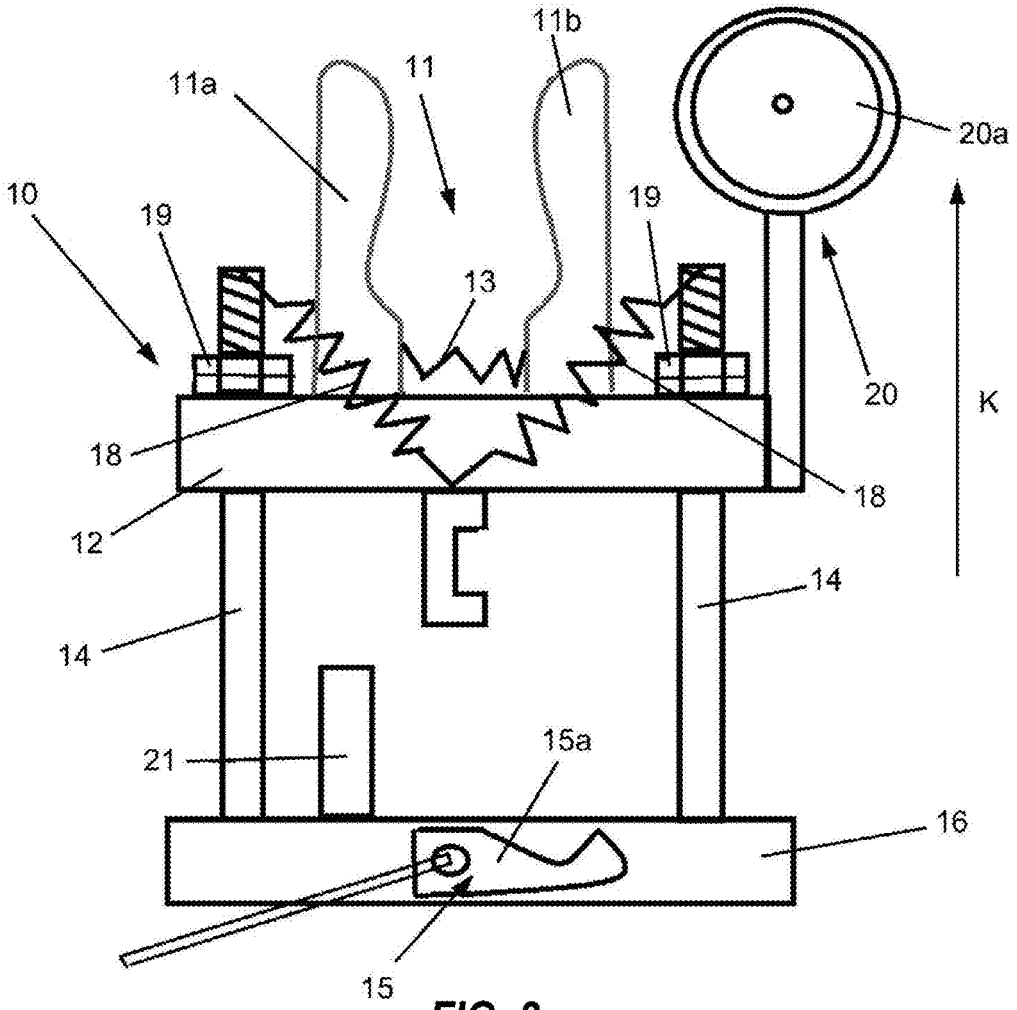
FIG. 3*a* shows a schematic top view of the container holder of FIG. 1*a* in a compensation state in which the container is holdable eccentrically.
Figure 3B:
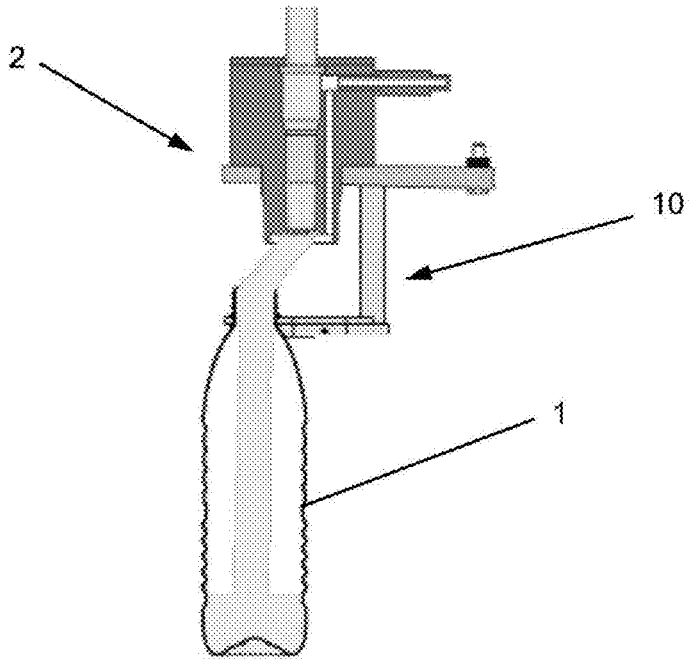
FIG. 3*b* shows a schematic side view of the container holder of FIG. 3*a* with a received container and a filling member arranged above it.

The transfer between the normal state and the compensation state can be realized by a spring-controlled mechanism, as shown in FIGS. 1*a*, 2 and 3*a*. It must be pointed out that multiple compensation states can obviously be provided in order to be able to compensate for various degrees of deflection of the filler jet. In particular, a continuous transfer from the normal state to a maximum compensation state according to FIG. 3*a* can be realized.

The spring-controlled mechanism according to the present example embodiment includes one or multiple compensation springs 18 which prestress the compensation carrier 12 into the compensation state. In the simplest case, the compensation springs 18 are fastened to the compensation carrier 12 and in each case to an end portion of a corresponding guide element 14. The holding portion 11 is consequently prestressed to an eccentric position below the filling member 2. The end position, i.e. the maximum compensation state, can be defined by a stop 19 which is adjustable. The stop 19 can be realized, for example, by two lock nuts which each engage in a threaded portion of the guide elements 14.

An adjusting portion 20, which adjusts the position of the compensation carrier 12, is situated on the compensation carrier 12 according to the present example embodiment. The adjusting portion 20 includes, for this purpose, for example, a roller 20*a* which interacts with a cam segment 3 (cf. FIG. 2) of the filling device. In the region of the container transfer to the holding portion 11 and/or of the container delivery to a subsequent station, the compensation carrier 12 is pressed against the prestressing action of the compensation springs 18 into the normal state below the filling member 2 by a cam of the cam segment 3 which acts on the roller 20*a*. According to said example embodiment, the actuation of the compensation carrier 12 is realized by a combination of a cam control system and a spring-controlled mechanism.

In this way, the transfer between the normal state and the at least one compensation state can be realized in a technically simple and reliable manner. However, it must be pointed out that the actuation of the compensation carrier 12 can also be realized in a different manner, for example by a pressure damper, electromotively, hydraulically, pneumatically, magnetically, etc.

In addition, the container holder 10 can comprise a support 21 behind the compensation carrier 12 which stabilizes the movable holding portion 11 in the normal state when said movable holding portion is pressed into the normal state by the roller 20*a*. The support 21 consequently serves as a normal-state-side stop which defines and stabilizes the correct position of the compensation carrier 12 in the normal state in a mechanical manner. The support 21 can be fastened to the main carrier 16 in order, as a result, to ensure a minimum distance between the main carrier 16 and the compensation carrier 12.

A filling device provided with compensatory container holders 10 can comprise a control unit/logic unit which determines and actuates the correct compensation state. Such a control unit can be set up additionally to indicate whether the increase in performance output as a result of eccentric filling prevents an increase in the filler pitch circle. Eccentric filling can thus result in an increase in the performance output of the filling device, as a result of skilled utilization of or adaptation to the physical conditions.

The container holders 10 set out herein can contribute to an increase in a performance output of a filling device provided with said container holders without increasing the number of filling members 2. This applies, in particular, to the filling of comparatively small-volume containers where an increase in performance output is less restricted by the maximum rate of flow of the filling members 2 but more by the speed of rotation of the filler carousel. Existing filling devices can be retrofitted with the container holders 10 in a simple manner. Designs relating to the inlet and outlet, the container transfer, the filling members 2 etc. do not have to be fundamentally modified but at best adapted although it is possible to dispense with even an adaptation in many cases. In addition, the container holders 10 allow the compensation facility to be deactivated for smaller output performances.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

Where applicable, all the individual features shown in the embodiments can be combined and/or interchanged with one another, without departing from the scope of the invention.

The invention claimed is:

1. A container holder for a device for filling containers with a product, the container holder comprising:

a holding portion configured to receive and hold a container;

a main carrier attachable to a filling device for filling the container with a filling product; and a compensation carrier attached to the holding portion, the compensation carrier being linearly adjustable in a compensation direction relative to the main carrier, wherein the compensation carrier is linearly adjustable from a first state, in which a mouth of the container held in the compensation carrier is situated substantially centrally under an outlet of a filling member of the filling device, into at least one second state, in which the mouth of the container is offset relative to the outlet of the filling member and is linearly adjustable from the second state to the first state.

2. The container holder of claim 1, wherein the holding portion includes two clamping arms which are mounted to be pivotable on the compensation carrier and are produced from a flexible material.

3. The container holder of claim 2, wherein the clamping arms are prestressed into a compressed position.

4. The container holder of claim 1, further comprising one or more guide elements, wherein the compensation carrier is displaceable along the compensation direction guided by the guide elements.

5. The container holder of claim 1, wherein the holding portion includes two clamping arms that are prestressed into a compressed position, are mounted to be pivotable on the compensation carrier, and are produced from a flexible material.

6. The container holder of claim 1, further comprising one or more stops configured to be adjustable for defining the first state, the second state, or both the first and the second states.

7. The container holder of claim 1, wherein the compensation carrier is prestressed into one of the first state and the second state.

8. The container holder of claim 7, further comprising one or multiple compensation springs which prestresses the compensation carrier into the one of the first state and the second state.

9. The container holder of claim 1, further comprising a locking device configured to fix the compensation carrier in the first state, the second state, or both the first and second states, wherein the locking device is switchable in a program-controlled manner.

10. The container holder of claim 9, wherein the locking device includes at least one hook which is attached so as to be pivotable on the main carrier and is movable into engagement with a first counter piece on the compensation carrier and is releasable from the engagement or is attached so as to be pivotable on the compensation carrier and is movable into engagement with a second counter piece on the main carrier and is releasable from the engagement.

11. The container holder of claim 1, further comprising an adjusting portion that is configured to adjust a position of the compensation carrier, wherein the adjusting portion includes a roller that is configured to interact with a cam segment of the filling device.

12. The container holder of claim 11, wherein the adjusting portion of the container holder in conjunction with the cam segment are configured such that in a region where the container transfers to the holding portion and/or the container is output to a subsequent station the compensation carrier is moved into the first state using the roller and the compensation carrier is situated in the second state during the filling of the container.

13. A filling device comprising:

a container holder comprising:

a holding portion configured to receive and hold a container;

a main carrier attachable to the filling device for filling the container with a filling product; and a compensation carrier attached to the holding portion, the compensation carrier being linearly adjustable in a compensation direction relative to the main carrier, wherein the compensation carrier is linearly adjustable from a first state, in which a mouth of the container held in the compensation carrier is situated substantially centrally under an outlet of a filling member of the filling device, into at least one second state, in which the mouth of the container is offset relative to the outlet of the filling member and is linearly adjustable from the second state to the first state, wherein the filing device is configured to move the container by way of the container holder during the filling with the filling product along a trajectory which is curved at least in portions.

14. The filling device of claim 13, wherein the filling device is a rotary machine with a filler carousel which comprises the container holder and transports the container holder along a circle segment during the filling of the container.

15. The filling device of claim 14, wherein the compensation direction (K) corresponds to a radial direction of the filler carousel or includes at least one non-vanishing vector component in the radial direction.

16. The filing device of claim 13, wherein the container holder further comprises an adjusting portion that is configured to adjust a position of the compensation carrier, wherein the adjusting portion includes a roller.

17. The filling device of claim 16, further comprising a cam segment where the cam segment together with the adjusting portion of the container holder are configured such that in a region where the container transfers to the holding portion and/or the container is output to a subsequent station the compensation carrier is moved into the first state by a cam of the cam segment which acts on the roller and the compensation carrier is situated in the second state during the filling of the container.

* * * * *